US006516497B2

(12) United States Patent
Färber et al.

(10) Patent No.: US 6,516,497 B2
(45) Date of Patent: Feb. 11, 2003

(54) APPARATUS FOR REMOVING MATERIAL FROM A ROLL OF A FIBER PROCESSING MACHINE

(75) Inventors: Christoph Färber, Korschenbroich (DE); Robert Többen, Mönchengladbach (DE)

(73) Assignee: Trützschler GmbH & Co., KG, Mönchengladbach (DE)

( * ) Notice: Subject to any disclaimer, the term of this patent is extended or adjusted under 35 U.S.C. 154(b) by 0 days.

(21) Appl. No.: 10/138,321

(22) Filed: May 6, 2002

(65) Prior Publication Data

US 2002/0166211 A1 Nov. 14, 2002

(30) Foreign Application Priority Data

May 9, 2001 (DE) ..... 101 22 459.1

(51) Int. Cl.[7] ..... D01B 3/00
(52) U.S. Cl. ..... 19/200; 19/107; 19/203
(58) Field of Search ..... 19/65 R, 65 A, 19/200, 202, 203, 204, 205, 98, 99, 100, 101, 105, 106 R, 107, 108, 109, 112; 209/146, 149

(56) References Cited

U.S. PATENT DOCUMENTS 5,146,652 A * 9/1992 Leifeld ..... 19/200
5,313,688 A * 5/1994 Leifeld et al. ..... 19/107
5,546,635 A * 8/1996 Leifeld ..... 19/200
5,613,278 A * 3/1997 Temburg ..... 19/105

FOREIGN PATENT DOCUMENTS

| | | |
|---|---|---|
| DE | 11 14 127 | 3/1962 |
| DE | 39 11 897 | 2/1990 |
| DE | 39 01 313 | 7/1990 |
| DE | 41 30 147 | 3/1992 |

* cited by examiner

*Primary Examiner*—Gary L. Welch
(74) *Attorney, Agent, or Firm*—Robert Kinberg; Venable, LLP.

(57) ABSTRACT

A fiber processing machine includes a clothed roll entraining fiber material thereon; a roll cover circumferentially partially surrounding the roll and defining an annular clearance therewith; a transfer opening provided in the roll cover for admitting fiber material to the roll; a waste discharge opening provided in the roll cover for removing waste from the clearance; a fiber removal opening provided in the roll cover downstream of the waste discharge opening as viewed in the direction of roll rotation; an arrangement for generating an air stream for doffing fiber material from the roll and for discharging doffed fiber material through the fiber removal opening; an arrangement for varying a strength of the air stream at the fiber removal opening; and an arrangement for varying the extent of waste removal through the waste discharge opening.

15 Claims, 3 Drawing Sheets

APPARATUS FOR REMOVING MATERIAL FROM A ROLL OF A FIBER PROCESSING MACHINE

CROSS REFERENCE TO RELATED APPLICATION

This application claims the priority of German Application No. 101 22 459.1 filed May 9, 2001, which is incorporated herein by reference.

BACKGROUND OF THE INVENTION

This invention relates to an apparatus integrated in a fiber processing machine, such as a card, a cleaner, an opener or the like for fiber material such as cotton and chemical fibers. The fiber processing machine has roll cover elements associated with a rapidly rotating roll. Between the cover elements a plurality of openings are provided. A first opening serves for the discharge of foreign bodies, such as trash, seed fragments, leaf fragments and the like whereas a second opening which is arranged downstream of the first opening as viewed in the rotary direction of the roll, serves for discharging fiber material by an air stream.

German patent document No. 1 114 127 describes an apparatus in which the fiber tufts, freed from a preponderant part of foreign bodies, are brought on a doffer in the effective zone of an air stream which carries the fiber tufts to a screening drum separator or a pneumatic transport device. The doffer has a sawtooth-like clothing whose teeth are inclined in the direction of roll rotation so that the fiber web attached to the teeth is readily removed by the suction air stream. The air stream is drawn from the outside through a gap. It is a disadvantage of such a prior art construction that it is not possible to vary the air stream. An outlet opening for the foreign bodies in the cover for the doffer is not present because the fiber material on the doffer has already been substantially cleaned.

SUMMARY OF THE INVENTION

It is an object of the invention to provide an apparatus of the above-outlined type from which the discussed disadvantages are eliminated and which, in particular, makes possible a variation of the fiber-doffing air stream and also provides for an improved waste quality at an outlet opening.

This object and others to become apparent as the specification progresses, are accomplished by the invention, according to which, briefly stated, the fiber processing machine includes a clothed roll entraining fiber material thereon; a roll cover circumferentially partially surrounding the roll and defining an annular clearance therewith; a transfer opening provided in the roll cover for admitting fiber material to the roll; a waste discharge opening provided in the roll cover for removing waste from the clearance; a fiber removal opening provided in the roll cover downstream of the waste discharge opening as viewed in the direction of roll rotation; an arrangement for generating an air stream for doffing fiber material from the roll and for discharging doffed fiber material through the fiber removal opening; an arrangement for varying a strength of the air stream at the fiber removal opening; and an arrangement for varying the extent of waste removal through the waste discharge opening.

By setting the strength of the air stream for removing the fiber material at the fiber removal opening, it is feasible to improve the waste quality at a separating location situated upstream of the fiber removing location. It is a particular advantage of the invention that an adjustment of the air stream also affects the vacuum between the cover and the roll, and thus the intensity of the removal of foreign bodies at the waste discharge opening is improved. In this manner the ratio between the desired separation of foreign bodies and an undesired separation of good fibers is optimized. It is in particular feasible to ensure, to the extent possible, a minimum loss on good fibers in the foreign body separating process.

DESCRIPTION OF THE PREFERRED EMBODIMENTS

Figure 1:
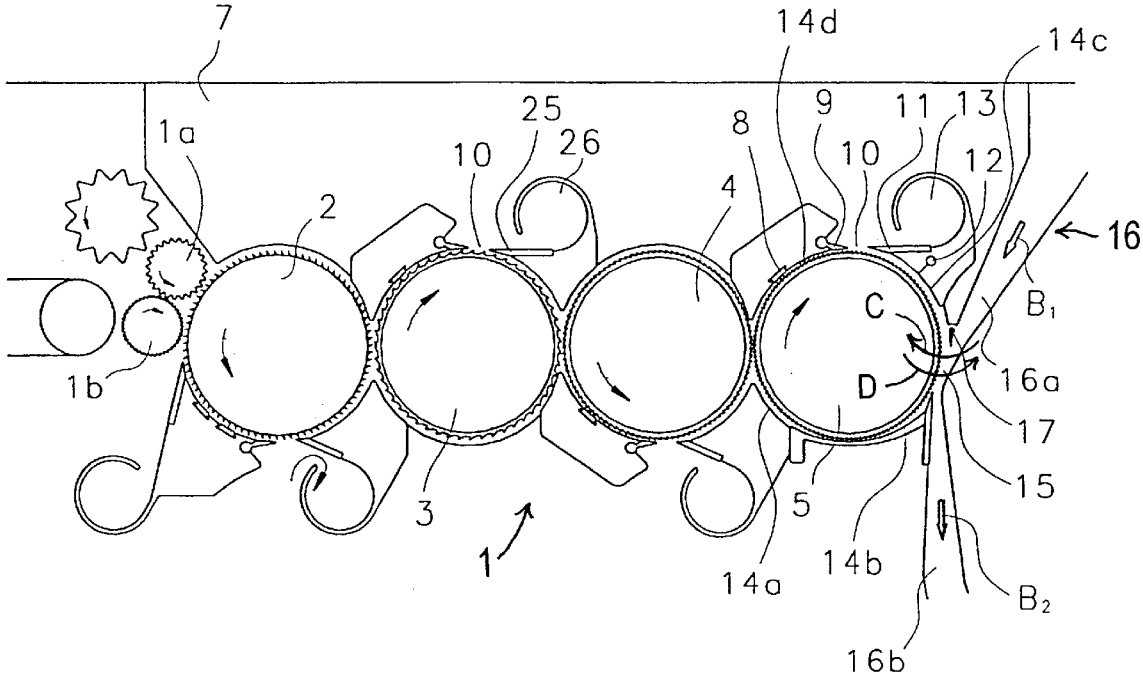
FIG. 1 is a schematic side elevational view of a four-roll cleaner incorporating the invention.
Figure 3A:
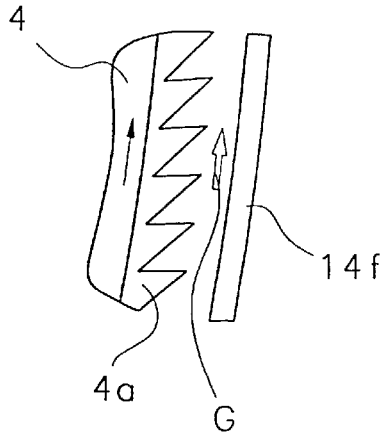
FIG. 3*a* is a fragmentary side elevational view of a fiber processing roll and the cover element associated therewith to illustrate the vacuum air stream.
Figure 3:
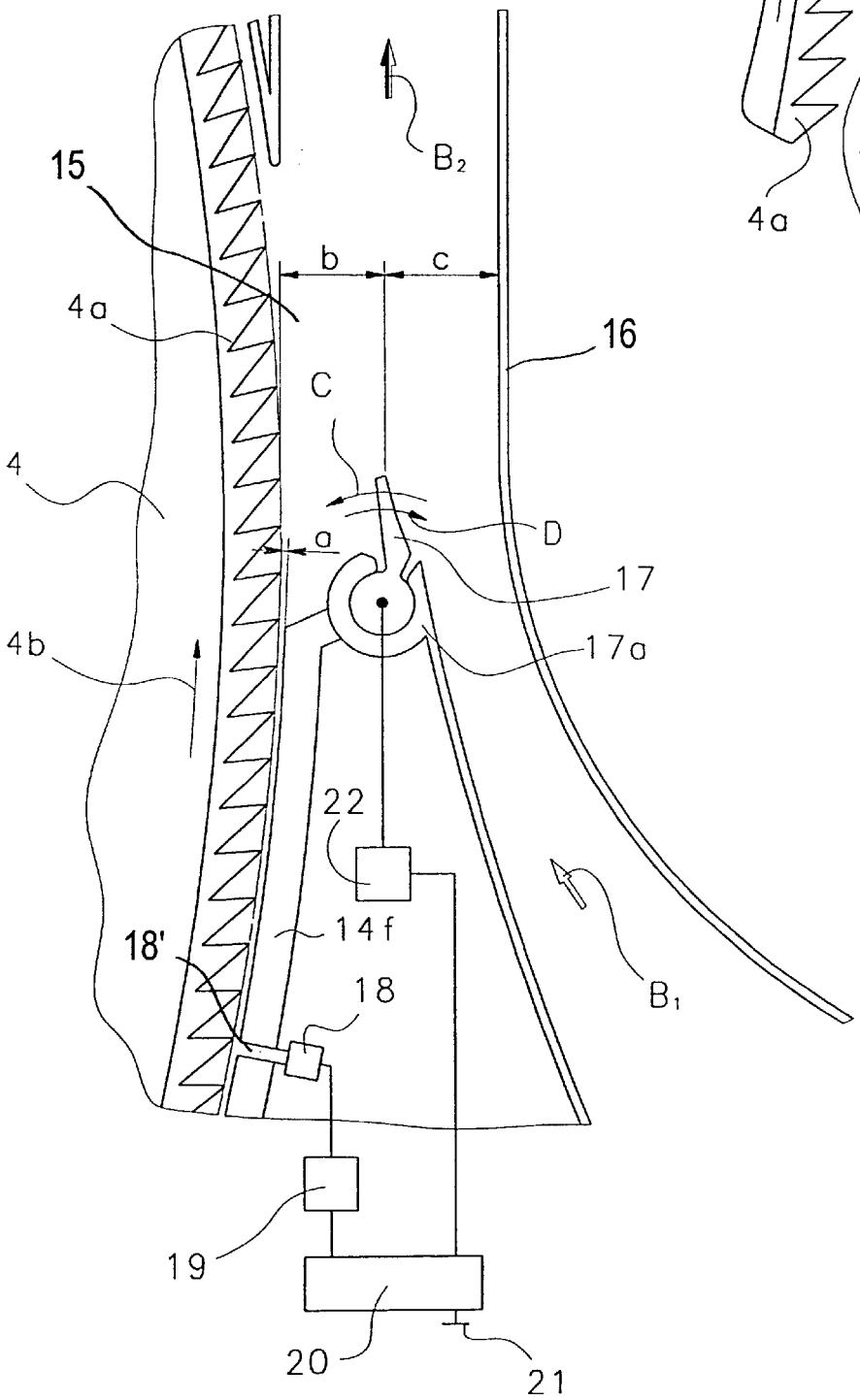
FIG. 3 is an enlarged detail of FIG. 2, showing a regulator and setting member for a flow rate setting element.

FIG. 1 illustrates a four-roll cleaner 1 which may be a CVT 4 model manufactured by Trützschler GmbH & Co. KG, Mönchengladbach, Germany. The fiber material is introduced into the nip of cooperating feed rollers 1*a*, 1*b* which clamp the material and advance it to a pin roll 2, having a circumferential velocity of approximately 10–21 m/sec. From the pin roll 2 the material is transferred to a sawtooth roll 3, having a circumferential velocity of approximately 15–25 m/sec. The sawtooth roll 3 is followed by additional sawtooth rolls 4 and 5. The rolls 2–5 have a diameter of approximately 150–300 mm and are enclosed in a cleaner housing 7. The roll 5 is associated with a stationary carding element 8, an adjustable guide element 9, an air and waste discharge opening 10, a separating knife 11 and a pressure sensor 12. The separating knife 11 is adjoined by a suction hood 13. The pressure sensor 12 and the adjustable guide element 9 may be connected to an electronic control and regulating device, such as a microcomputer, as illustrated in FIG. 3. The roll 5 is surrounded by a cover which is composed of a plurality of arcuate cover elements 14*a*, 14*b*, 14*c* and 14*d*. Between the cover elements 14*d* and 14*c* the waste discharge opening 10 is provided through which foreign bodies and other impurities are separated from the fiber material. Between the cover elements 14*c* and 14*b* a fiber removal opening 15 is provided, through which the fiber material is taken off the roll 5 by an air stream $B_1$, $B_2$. Between the cover elements 14*a* and 14*d* a transfer opening 30 is provided to allow transfer of the fiber material from the roll 4 to the roll 5. The roll 5 is associated with a pneumatic fiber removal device which comprises a duct 16 merging into the opening 15 bordered by a circumferential portion of the roll 5. The duct 16 has an air supply duct portion 16*a* through which an air stream $B_1$ is drawn for contacting the circumferential portion of the roll 5 exposed in the opening 15. The air supply duct portion 16*a* is adjoined by an air removal duct portion 16*b* through which a fiber/air mixture $B_2$ is drawn away from the roll 5. The duct portion 16*b* is coupled to a non-illustrated vacuum source. As shown in FIG. 1, the air stream $B_1$, $B_2$ flows substantially downward from above. At the upstream end of the opening 15 an air flow rate setting element (guide vane) 17 is disposed which is pivotally supported for swinging motions in the direction of arrows C and D. By means of the air flow rate setting element 17 the strength of the fiber doffing air stream $B_1$, $B_2$ is adjustable and thus the degree of separation of foreign bodies through the waste discharge opening 10 may be controlled. The strength of the air stream $B_1$, $B_2$ depends from the flow rate and/or the air speed and/or the air pressure.

Figure 2:
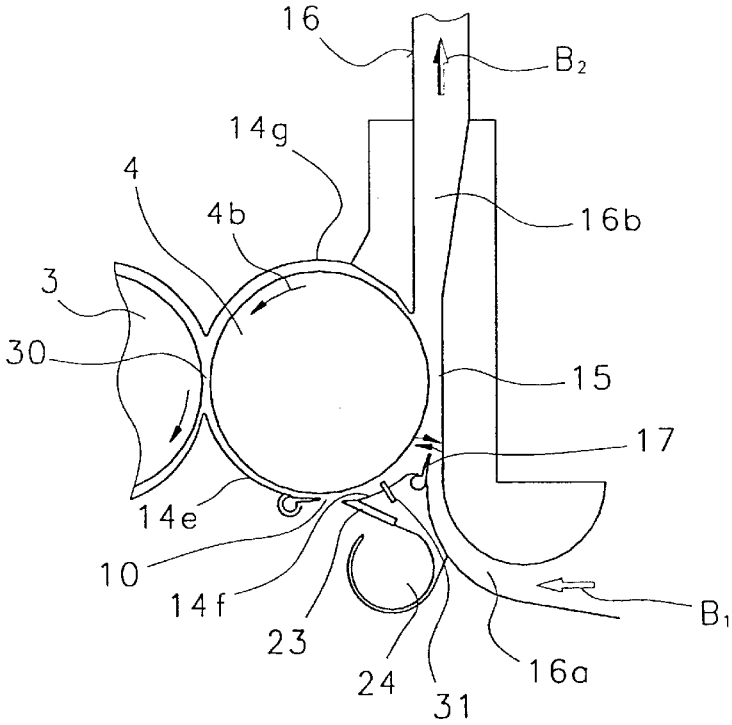
FIG. 2 is a schematic fragmentary sectional side elevational view of a three-roll cleaner incorporating the invention.

FIG. 2 partially shows a three-roll cleaner which may be a CXL 3 model manufactured by Trützschler GmbH & Co. KG. The air stream $B_1$, $B_2$ serving for removing the fiber material from the roll 4 flows essentially from below upwardly through the duct 16. By means of the air flow rate setting element 17 the strength of the air stream is affected by virtue of a throttle effect. The roll 4 is surrounded by a cover which is composed of a plurality of arcuate cover elements 14*e*, 14*f* and 14*g*. While in the illustrated construction the flow rate of the air stream $B_1$, in the duct portion 16*a* is set, the air stream $B_2$ and the vacuum stream G (FIG. 3*a*) between the cover portion 14*f* and the surface of the roll 4 are also changed. The waste discharge opening 10 is in communication with a suction hood 24 and is bordered by a separating knife 23. By virtue of this arrangement the air supply in the region of the fiber removal opening 15 may be adjusted. At the same time an adjustable vacuum is provided immediately downstream of the waste discharge opening 10 by an airflow rate setting element 31 which varies the extent of waste removal through the Waste discharge opening 10.

Turning to FIG. 3, a pressure sensor 18 is arranged upstream of the air-doffer (fiber removal) opening 15 and the air flow rate setting element 17, as viewed in the direction of rotation 4*b* of the roll 4. The pressure sensor 18 detects the static pressure prevailing in the annular clearance a between the cover element 14*f* and the roll clothing 4*a*. The sensor 18 communicates with the annular clearance a via a through bore 18' provided in the cover element 14*f*. The measured pressure values are utilized for setting the distance b of the setting element 17 from the points of the roll clothing 4*a*. Such a setting may be effected manually or automatically as a function of the measured values supplied by the pressure sensor 18. For such an automatic regulation the pressure sensor 18 applies its signals to a transducer 19 which converts the pressure values into electric signals. The transducer 19, in turn, applies its signals to a regulator 20 which is provided with a nominal value setter 21, for example, a microcomputer. The regulator 20 is connected with the adjustable guide element 17 by means of a setting member such as a stepping motor 22. In the regulator 20 the actual pressure values are compared with the nominal pressure values and, in case of a deviation, setting signals are applied to the element 17 by the stepping motor 22. The air flow rate setting element 17 journals in a support 17*a* and is thus rotatable in the direction of the arrows C, D. In addition to adjusting the clearance b as noted earlier, the guide element 17 also varies the clearance c between the guide element 17 and the facing portion of the inner wall of the duct 16.

By setting the strength of the air stream $B_1$, $B_2$ for doffing the fiber material through the fiber removal opening 15, it is feasible to improve, apart from the change of degree in the fiber doffing, the waste quality at the waste discharge opening 10 situated upstream of the fiber removal opening 15. It is a particular advantage of this arrangement that by virtue of adjusting the air stream, the vacuum between the cover (designated at 14*c* in FIG. 1 and at 14*f* in FIG. 2) and the respectively last roll 5 or 4 thus has an effect on the intensity of the separation of foreign bodies through the opening 10. In this manner, the ratio between the desired separation of foreign bodies and the undesired separation of good fibers is optimized. It is in particular possible to keep the loss of good fibers at a minimum during the foreign body separation.

The presence of vacuum downstream of the respective separating knife 11 and 23 is advantageous to ensure that a separation of good fibers through the waste removal opening 10 is kept at a minimum. Such a vacuum is generated by the air stream passing through the fiber removal opening 15 with the air-doffed fiber material. By throttling the air admission to the air stream which carries the fiber material through the opening 15, the vacuum may be varied behind the separating knife and thus the waste quality of the last separating location (waste discharge opening 10) may be affected. The vacuum is generated by the air stream G shown in FIG. 3*a*.

Figure 4:
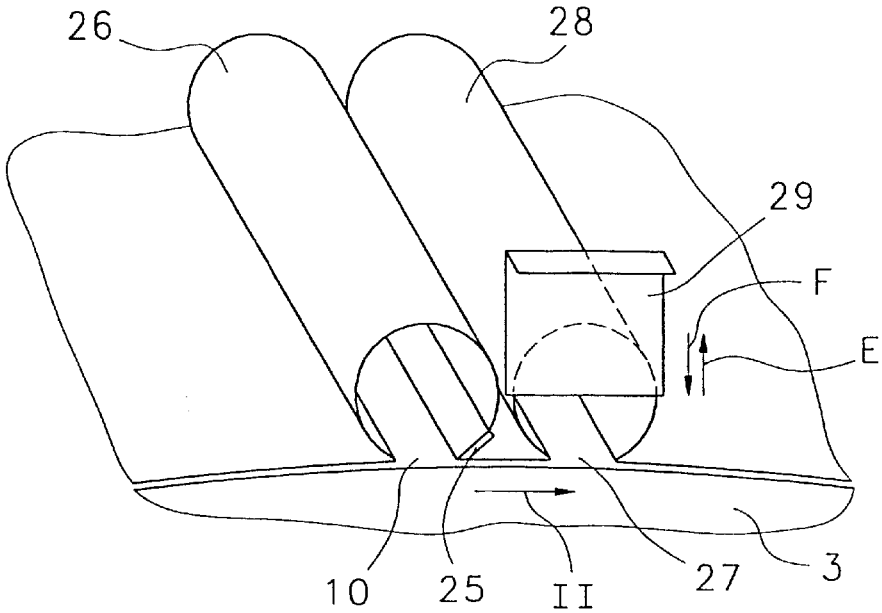
FIG. 4 is as schematic perspective view of a suction hood arranged immediately downstream of a location where foreign bodies are separated.

Each waste separating location which is not followed by a suction location for the fiber material may be complemented by a suction hood in which a vacuum stream is generated by a vacuum source attached to the suction hood. The strength of the generated vacuum may be adjusted by an appropriate setting element or may be regulated. Such an arrangement is shown in FIG. 4 and may be incorporated in the FIG. 1 cleaner, at the roll 3 which is associated with a waste separating opening 10, a separating knife 25 and a suction hood 26. As seen in FIG. 4 and viewed in the direction of rotation of the roll 3, downstream of the waste discharge opening II 10 an air passage opening 27 is arranged which is adjoined by a suction hood 28. A throttle slide 29 arranged at an end of the suction hood 28 is movable in the direction E, F to vary the flow passage cross section for the drawn air. The suction hoods 26 and 28 are coupled to non-illustrated suction sources. Through the suction hood 28 solely air (that is, no fiber material) is withdrawn.

Figure 5:
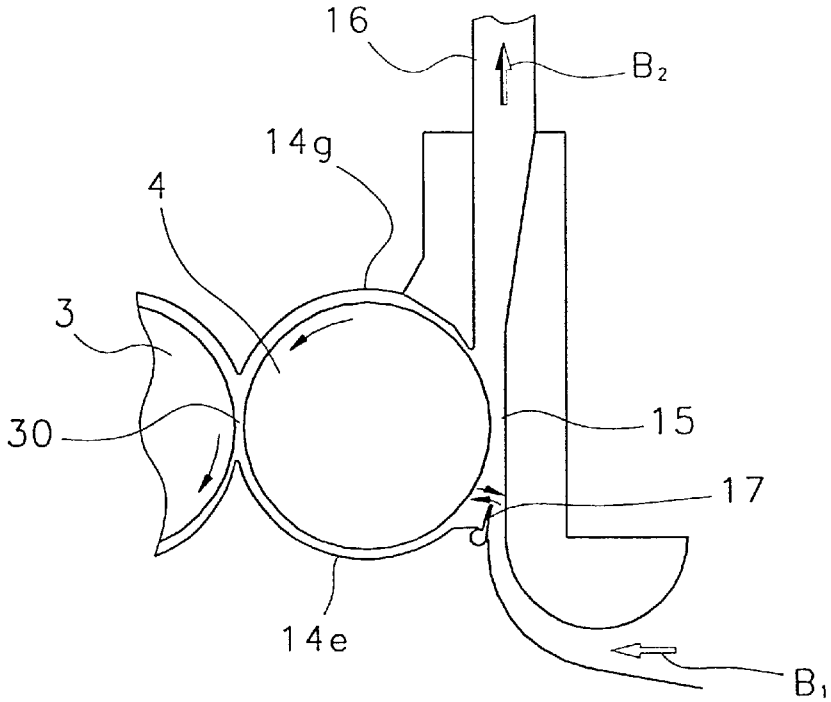
FIG. 5 is a side elevational view of a variant of the FIG. 2 construction.

FIG. 5 shows a fiber processing machine similar to that illustrated in FIG. 2 except it is not provided with a separating location for foreign bodies. Such a fiber processing machine may be a chemical fiber opener. By virtue of the adjustable air flow rate setting element 17 the strength of the fiber doffing air stream $B_1$ and $B_2$ may be varied.

The features according to the invention described in connection with roll 5 of the four-roll cleaner of FIG. 1 and the three-roll cleaner of FIG. 2 may find application at a licker-in and/or a main carding cylinder of a carding machine.

It will be understood that the above description of the present invention is susceptible to various modifications, changes and adaptations, and the same are intended to be comprehended within the meaning and range of equivalents of the appended claims.

What is claimed is:

1. In a fiber processing machine including a clothed roll having a direction of rotation and entraining fiber material thereon;

a roll cover circumferentially partially surrounding said roll and defining an annular clearance therewith;

a transfer opening provided in said roll cover for admitting fiber material to said roll;

a waste discharge opening provided in said roll cover for removing waste from said clearance;

a fiber removal opening provided in said roll cover downstream of said waste discharge opening as viewed in said direction of rotation; and first means for generating an air stream for doffing fiber material from said roll and for discharging doffed fiber material through said fiber removal opening;

the improvement comprising:

(a) second means for varying a strength of said air stream at said fiber removal opening; and (b) third means for varying the extent of waste removal through said waste discharge opening.

2. The fiber processing machine as defined in claim 1, wherein said fiber processing machine is a carding machine and said roll is a main carding cylinder.

3. The fiber processing machine as defined in claim 1, wherein said fiber processing machine is a cleaner.

4. The fiber processing machine as defined in claim 1, further comprising a separating knife bordering said waste discharge opening.

5. The fiber processing machine as defined in claim 1, further comprising a suction hood communicating with said waste discharge opening for withdrawing air therethrough.

6. The fiber processing machine as defined in claim 1, further comprising:

(a) a pressure sensor supported by said roll cover for detecting a static pressure prevailing in said clearance; and (b) fourth means for applying setting signals, representing pressure values detected by said sensor, to said second means.

7. The fiber processing machine as defined in claim 6, wherein said fourth means comprises (a) a regulator connected to said pressure sensor for receiving signals from said pressure sensor;

(b) a nominal value setter connected to said regulator; and (c) a setting member connected to said regulator for receiving signals from said regulator as a function of pressure sensor signals and nominal values applied to said regulator by said nominal value setter; said setting member being connected to said second means for moving said second means as a function of signals received from said setting member.

8. The fiber processing machine as defined in claim 1, further comprising a duct composed of first and second duct portions for guiding the air stream onto and away from said roll, respectively; further wherein said second means comprises a movable flow rate adjusting element supported in said duct.

9. The fiber processing machine as defined in claim 8, wherein said fiber removal opening has upstream and downstream ends as viewed in said direction of rotation; further wherein the adjusting element is arranged at said upstream end.

10. The fiber processing machine as defined in claim 1, further comprising (a) an air outlet opening provided in said roll cover and adjoining said waste discharge opening downstream thereof; and (b) an additional hood communicating with said air outlet opening for withdrawing air therethrough.

11. The fiber processing machine as defined in claim 10, further comprising means for varying a flow passage area of said air outlet opening.

12. The fiber processing machine as defined in claim 1, wherein said second means comprises a rotatably supported vane.

13. The fiber processing machine as defined in claim 12, wherein said vane is arranged for varying a gap defined between said roll and said vane.

14. The fiber processing machine as defined in claim 12, wherein said vane is rotatably supported in said roll cover.

15. In a fiber processing machine including a clothed roll having a direction of rotation and entraining fiber material thereon;

a roll cover circumferentially partially surrounding said roll and defining an annular clearance therewith;

a transfer opening provided in said roll cover for admitting fiber material to said roll;

a fiber removal opening provided in said roll cover downstream of said transfer opening as viewed in said direction of rotation; and first means for generating an air stream for doffing fiber material from said roll and for discharging doffed fiber material through said fiber removal opening;

the improvement comprising second means for varying a strength of said air stream at said fiber removal opening.

* * * * *